US009493863B2

(12) United States Patent
Kang

(10) Patent No.: US 9,493,863 B2
(45) **Date of Patent: *Nov. 15, 2016**

(54) WEAR-RESISTANT ALLOY HAVING COMPLEX MICROSTRUCTURE

(71) Applicant: Hyundai Motor Company, Seoul (KR)

(72) Inventor: Hee Sam Kang, Seoul (KR)

(73) Assignee: Hyundai Motor Company, Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 14/271,761

(22) Filed: May 7, 2014

(65) Prior Publication Data

US 2014/0334972 A1 Nov. 13, 2014

(30) Foreign Application Priority Data

May 7, 2013 (KR) ..... 10-2013-0051295

(51) Int. Cl.
*C22C 21/10* (2006.01)

(52) U.S. Cl.
CPC ..... *C22C 21/10* (2013.01)

(58) Field of Classification Search
CPC ..... C22C 21/00
See application file for complete search history.

(56) References Cited

U.S. PATENT DOCUMENTS

| | | | | |
|---|---|---|---|---|
| 4,452,366 | A | 6/1984 | Kamiya et al. | |
| 4,650,528 | A * | 3/1987 | Masumoto et al. | 148/437 |
| 6,605,370 | B2 | 8/2003 | Wittebrood et al. | |
| 2013/0095345 | A1* | 4/2013 | Maki et al. | 428/653 |

FOREIGN PATENT DOCUMENTS

| | | | |
|---|---|---|---|
| GB | 769483 | A | 3/1957 |
| JP | 05-078708 | A | 3/1993 |
| JP | 05-332364 | A | 12/1993 |
| JP | 07-197165 | A | 8/1995 |
| JP | 2000-096162 | A | 4/2000 |
| JP | 2002-012959 | A | 1/2002 |
| JP | 2005-076107 | A | 3/2005 |
| JP | 2005530032 | A | 10/2005 |
| JP | 2008542534 | A | 11/2008 |
| JP | 2011510174 | A | 3/2011 |
| JP | 2011514434 | A | 5/2011 |
| JP | 2013518184 | A | 5/2013 |
| KR | 94-002690 | B1 | 3/1994 |
| KR | 10-0670228 | B1 | 1/2007 |
| KR | 10-2008-0053472 | A | 6/2008 |

(Continued)

OTHER PUBLICATIONS

Kaufman, J. Gilbert Rooy, Elwin L.. (2004). Aluminum Alloy Castings—Properties, Processes, and Applications—2. Aluminum Casting Alloys. ASM International. Online version available at: http://app.knovel.com/hotlink/pdf/id:ktOOASDWF1/aluminum-alloy-castings/aluminum-casting-alloys.*

US 2013/0095345 A1 is the English equivalent of WO 2011/161833 A1 of Maki et al.*

(Continued)

*Primary Examiner* — Roy King
*Assistant Examiner* — Jophy S Koshy
(74) *Attorney, Agent, or Firm* — Mintz Levin Cohn Ferris Glovsky and Popeo, P.C.; Peter F. Corless

(57) ABSTRACT

A wear-resistant alloy having a complex microstructure, which may include a range of about 28 to 38 wt % of zinc (Zn), a range of about 1 to 3 wt % of tin (Sn), a range of about 0.4 to 1.4 wt of iron (Fe) and a balance of aluminum (Al), is provided.

4 Claims, 1 Drawing Sheet

(56) References Cited

FOREIGN PATENT DOCUMENTS

| | | | | |
|---|---|---|---|---|
| KR | 10-2008-0102560 | | 11/2008 | |
| KR | 10-2011-0097547 | A | 8/2011 | |
| KR | 10-2012-0102865 | A | 9/2012 | |
| WO | WO 2011161833 | A1 * | 12/2011 | ..... C23C 2/12 |

OTHER PUBLICATIONS

Miller, W.S. et al., "Recent development in aluminium alloys for the automotive industry", Materials Science and Engineering, A280 (2000) pp. 37-49.

* cited by examiner

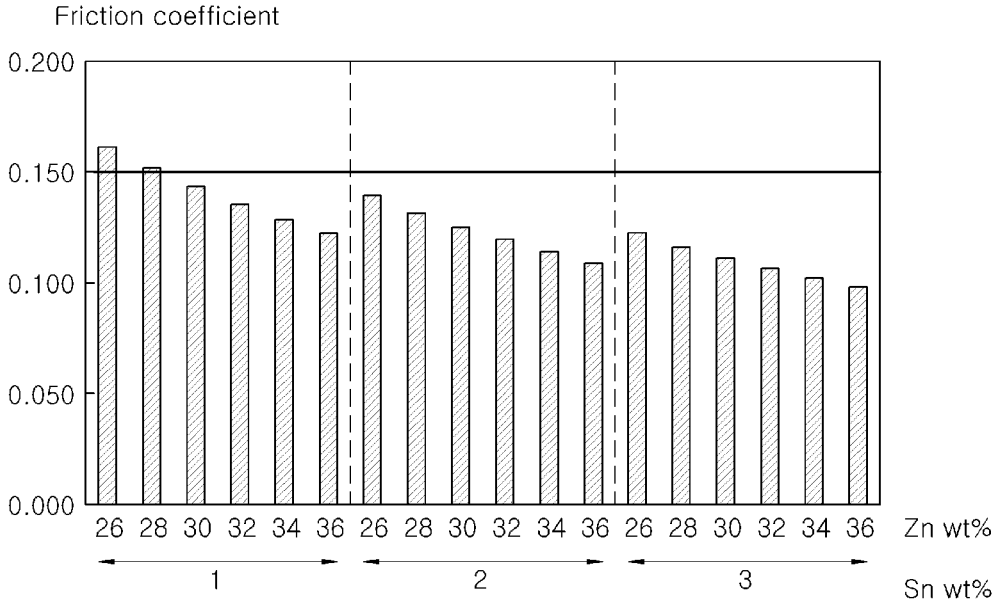
Friction coefficient
0.200
0.150
0.100
0.050
0.000
26 28 30 32 34 36 26 28 30 32 34 36 26 28 30 32 34 36
Zn wt%
1
2
3
Sn wt%

WEAR-RESISTANT ALLOY HAVING COMPLEX MICROSTRUCTURE

CROSS REFERENCE TO RELATED APPLICATION

The present application claims priority to Korean Patent Application No. 10-2013-0051295, filed on May 7, 2013, the entire contents of which is incorporated herein for all purposes by this reference.

TECHNICAL FIELD

The present invention relates to an aluminum alloy for use in vehicle parts which may require wear resistance and self-lubrication, and a method of manufacturing the aluminum alloy. In particular, the aluminum alloy having a complex microstructure, which may include wear-resistant hard particles and self-lubricating soft particles, is provided.

BACKGROUND

A wear-resistant aluminum alloy for use in vehicle parts may include a hypereutectic Al—Fe alloy which contains from about 13.5 to about 18 wt %, or particularly about 12 wt % or greater, of silicon (Si) and from about 2 to about 4 wt % of copper (Cu). The hypereutectic Al—Fe alloy may have a microstructure in which primary Si particles having a size of from about 30 to about 50 μm are included, and may have enhanced wear resistance compared to mere Al—Fe alloys. Thus, such hypereutectic Al—Fe alloy may be most widely used in vehicle parts which require wear resistance, such as a shift fork, a rear cover, a swash plate, and the like.

Examples of typical commercial alloys include R14 alloy (Ryobi, Japan), K14 which is similar to R14, and A390 alloy which is used in a monoblock or aluminum liner.

However, such a hypereutectic alloy having high Si content may have reduced castability and controlling the size and the distribution of Si particles may be difficult. Furthermore, this alloy may have low impact resistance and be specially developed, and thus may cost more than conventional aluminum alloys.

In addition, an example of a self-lubricating aluminum alloy for use in vehicle parts may include an Al—Sn alloy. This Al—Sn alloy may contain from about 8 to about 15 wt % of tin (Sn), and thus self-lubricating Sn soft particles may be produced in a microstructure, to thereby reduce friction. Therefore, this alloy has been used as a base material for a metallic bearing in high frictional contact interfaces. Although strength may be reinforced by adding Si, this alloy may have a low strength of about 150 MPa or less, and may not be used in structural parts.

The description provided above as a related art of the present invention is just merely for helping understanding of the background of the present invention and should not be construed as being included in the related art known by those skilled in the art.

SUMMARY OF THE INVENTION

Accordingly, the present invention may provide a technical solution to above-described problems. In particular, the present invention provides a novel alloy having a complex microstructure, which may include both hard particles and soft particles. Therefore, the novel alloy may be a self-lubricating high-strength wear-resistant alloy having both wear resistance from a hypereutectic Al—Fe alloy and self-lubrication from an Al—Sn alloy.

In one exemplary embodiment of the present invention, a wear-resistant alloy having a complex microstructure may comprise: a range of about 28 to 38 wt % of zinc (Zn), a range of about 1 to 3 wt % of tin (Sn), a range of about 0.4 to 1.4 wt % of iron (Fe) and a balance of aluminum (Al). The wear-resistant alloy may further comprise a range of about 1 to 3 wt % of copper (Cu). The wear-resistant alloy may also comprise a range of about 0.3 to 0.8 wt % of magnesium (Mg). In addition, the wear-resistant alloy may comprise a range of about 1 to 3 wt % of copper (Cu) and a range of about 0.3 to 0.8 wt % of magnesium (Mg).

In another exemplary embodiment of the present invention, a wear-resistant alloy having a complex microstructure may comprise: a range of about 28 to 38 wt % of zinc (Zn), a range of about 1 to 3 wt % of bismuth (Bi), a range of about 0.4 to 1.4 wt % of iron (Fe) and a balance of aluminum (Al).

BRIEF DESCRIPTION OF THE DRAWING

The above and other objects, features and advantages of the present invention will be more clearly understood from the following detailed description taken in conjunction with the accompanying drawing, in which:

FIG. 1 illustrates an exemplary graph showing a correlation between friction coefficient and an amount of Sn or Zn which may form soft particles in Examples and Comparative Examples for a wear-resistant alloy having a complex microstructure according to an exemplary embodiment of the present invention.

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about".

Hereinafter, a detailed description will be given of a wear-resistant alloy having a complex microstructure according to various exemplary embodiments of the present invention.

The present invention provides a novel aluminum alloy having a complex microstructure which may include both hard particles and soft particles.

In certain examples of conventional alloys, alloy elements for producing self-lubricating particles may include tin (Sn), lead (Pb), bismuth (Bi), zinc (Zn), and the like. Since these elements do not chemically react with Al, intermetallic compounds may not be produced and phase separation may not occur. Furthermore, such elements, which may have substantially low melting temperatures, may possess self-lubrication for forming a lubricating film while being partially melted under severe friction conditions.

Among the aforementioned four chemical elements, lead (Pb) may be the most suitable element for producing self-lubricating particles in consideration of self-lubrication and cost. However, lead is a harmful metal element and is prohibited in a vehicle industry.

Therefore, in an exemplary embodiment, tin (Sn) may bewidely utilized instead of Pb, or alternatively, bismuth (Bi) may be used instead of Pb. In addition, zinc (Zn) may have a substantially high melting temperature compared to Sn and Bi and may have substantially low self-lubrication. Therefore, Zn may be added in a substantially large amount, due to its low cost and and may be used as an element for producing soft particles and replacing a portion of the amount of expensive Sn or Bi in consideration of price competitiveness of materials.

In an exemplary embodiment, the alloying elements for producing hard particles may include Si and Fe. Si or Fe may have eutectic reactivity with Al, and may produce angular shaped hard particles when added in an amount equal to or greater than a predetermined amount. In the aluminum alloy, Si may produce hard particles, and may provide wear resistance. In particular, primary Si particles may be produced when Si is added in an amount of about 12.6 wt % or greater in the Al—Fe binary alloy. However, when Si is added together with Zn for producing soft particles, the amount of Si may vary depending on the amount of Zn to produce hard particles. For example, when the amount of Zn is about 10 wt %, Si may be added in an amount ranging from about 7 wt % to about 14 wt %. When Si is added in an amount less than about 7 wt %, hard particles may not be produced. In contrast, when Si is added in an amount greater than about 14 wt %, hard particles may be enlarged, thereby negatively affecting mechanical properties and wear resistance.

In an exemplary embodiment, iron (Fe) may be an impurity in Al—Fe alloys. However, when Fe is added in an amount of about 0.5 wt % or greater in the Al—Fe binary alloy without Si, wear-resistant Al—Fe intermetallic compound particles may be formed, and wear resistance may be enhanced. On the other hand, when Fe is added in an amount of about 3 wt % or greater, intermetallic compound may be formed excessively, thereby deteriorating mechanical properties and increasing the melting temperature.

In an exemplary embodiment, alloying elements for reinforcing fundamental strength may include Copper (Cu) and magnesium (Mg). Cu may form an intermetallic compound through a chemical reaction with Al and may substantially enhance mechanical strength of the aluminum alloy. The effect of Cu may vary depending on the amount of Cu and casting/cooling and thermal treatment conditions of the alloy. In addition, Mg may form an intermetallic compound through a chemical reaction with Si or Zn and may substantially enhance mechanical strength. The effect of Mg may vary depending on the amount of Mg and casting/cooling and thermal treatment conditions of the alloy, likewise Cu.

Hereinafter, the present invention will be described in more detailed exemplary embodiments.

In an exemplary embodiment, an aluminum alloy may include mainly of Al, a range of about 28 to 38 wt % of Zn, a range of about 1 to 3 wt % of Sn, a range of about 1 to 3 wt % of Cu, a range of about 0.3 to 0.8 wt % of Mg, and a range of about 0.4 to 1.4 wt % of Fe for producing hard particles. In particular, when Zn is added in an amount less than about 28 wt %, production of the Zn phase corresponding to soft particles may be substantially low, and sufficient self-lubrication may not be obtained. In contrast, when Zn is added in an amount greater than about 38 wt %, the solidus of the alloy may be substantially low and thus unfavorable casting conditions may result.

In an exemplary embodiment, Sn may have higher self-lubrication than Zn but is more expensive. When Sn is added in an amount less than about 1 wt %, production of the Sn phase in forms of soft particles may be substantially low, and thus low self-lubrication of the Zn phase may not be compensated. In contrast, when Sn is added in an amount greater than 3 wt %, an additional self-lubrication effect may not be significant compared to the cost increase. Therefore, the amount of Sn may be limited as above.

In an exemplary embodiment, when Fe for producing hard particles is added in an amount less than about 0.4 wt %, an Al—Fe intermetallic compound in forms of hard particles may not sufficiently produced, for instance, less than about 0.5%, and thus the wear resistance may not be ensured. In contrast, when the amount of Fe is greater than about 1.4 wt %, the liquidus temperature at which the Al—Fe hard particles are produced may substantially increase, for instance, higher than 750° C., thereby reducing castability and causing negative effects due to coarsening of the intermetallic compound.

In addition, when Cu is added to enhance mechanical properties, the amount of Cu may be about 1 wt % or greater to ensure appropriate mechanical properties. However, when Cu is added in an amount greater than 3 wt %, intermetallic compounds with the other elements may be produced, and mechanical properties may deteriorate. Therefore, the amount of Cu may be limited as above. Alternatively, when Mg is added in an amount of 0.3 wt % or greater, additional improvements in mechanical properties may be obtained. However, when Mg is added in an amount greater than about 0.8 wt %, Mg may also form a compound which degrades mechanical properties. Therefore, the amount of Mg may be limited as above.

The exemplary aluminum alloys from Examples and Comparative Examples for evaluating low friction properties by soft particles were manufactured while varying Zn and Sn amounts as illustrated in FIG. 1, and changes in friction coefficient per alloy were measured. As result, desired low friction properties, for instance, friction coefficient of about 0.150 or less, maybe obtained in the exemplary 1Sn-28Zn alloy under the condition of about 1 wt % of Sn, although unsatisfactory results may be obtained in the Comparative Examples of 1Sn-26Zn alloy. Thus, when Zn is added in an amount of about 28 wt % under the condition that the minimum amount of Sn is 1 wt %, the desired low friction properties, for instance, friction coefficient of about 0.150 or less, may be obtained. Furthermore, when the amounts of Sn and Zn increase, substantially low friction properties may be obtained.

In Table 1, according to Comparative Examples and Examples, exemplary Al-35Zn-1Sn-yFe alloys were manufactured and wear resistance and mechanical properties thereof were evaluated.

TABLE 1

| | Al | Zn (wt %) | Sn (wt %) | Fe (wt %) | Cu (wt %) | Mg (wt %) | Al—Fe particle fraction (%) | Liquidus (° C.) | Strength (Mpa) |
|---|---|---|---|---|---|---|---|---|---|
| C. Ex. | Remainder | 35 | 1 | 0.2 | 2 | 0.5 | 0.2 | — | — |
| Ex. | Remainder | 35 | 1 | 0.4 | 2 | 0.5 | 0.5 | — | — |
| | Remainder | 35 | 1 | 0.6 | 2 | 0.5 | 0.8 | — | 355 |
| | Remainder | 35 | 1 | 1.4 | 2 | 0.5 | 4 | 750 | 390 |
| C. Ex. | Remainder | 35 | 1 | 1.6 | 2 | 0.5 | 5 | 755 | — |

As shown Table 1, for the exemplary the Al-35Zn-1Sn-yFe alloy system of Comparative Example using about 0.2 wt % of Fe, the Al—Fe particles in forms of hard particles may be produced in a small amount, for instance, less than about 0.5%, sufficient wear resistance may not be obtained. In contrast, when the amount of Fe is substantially high of about 1.6 wt %, the liquidus temperature at which the Al—Fe hard particles are formed may increase substantially, for instance, higher than about 750° C., thereby reducing castability and incurring negative effect due to coarsening of the intermetallic compound.

In addition, when the amount of Fe is from about 0.4 to about 1.4 wt %, hard particles may be produced in an appropriate level, and strength of from about 355 to about 390 MPa may be obtained, thereby ensuring both wear resistance and mechanical properties as desired.

According to another exemplary embodiment of the present invention, a wear-resistant alloy having a complex microstructure may include a range of about 28 to 38 wt % of Zn, a range of about 1 to about 3 wt % of Bi, a range of about 0.4 to 1.4 wt % of Fe and a balance of of Al. In particular, Bi may be added as a strong self-lubricating material instead of Sn.

Accordingly, the present invention provides a wear-resistant alloy having a complex microstructure. In particular, according to the exemplary wear-resistant alloys having a complex microstructure, a novel wear-resistant alloy having self-lubricating high-strength which may have both wear resistance from a hypereutectic Al—Fe alloy and self-lubrication from an Al—Sn alloy may be obtained.

Although the exemplary embodiments of the present invention depicted in the drawing have been disclosed for illustrative purposes, those skilled in the art will appreciate that various modifications, additions and substitutions are possible, without departing from the scope and spirit of the invention as disclosed in the accompanying claims.

What is claimed is:

1. A wear-resistant aluminum alloy having a complex microstructure, comprising:

a range of about 30 to 36 wt % of zinc (Zn);

a range of about 1 to 3 wt % of tin (Sn);

a range of about 0.4 to 1.4 wt % of iron (Fe);

and a balance of aluminum (Al);

wherein an Al—Fe particle fraction of the wear-resistant alloy ranges from about 0.5 to about 4%;

and a friction coefficient of the wear-resistant alloy is about 0.150 or less.

2. The wear-resistant alloy of claim 1, further comprising a range of about 1 to 3 wt % of copper (Cu).

3. The wear-resistant alloy of claim 1, further comprising a range of about 0.3 to 0.8 wt % of magnesium (Mg).

4. The wear-resistant alloy of claim 1, further comprising a range of about 1 to 3 wt % of copper (Cu) and a range of about 0.3 to 0.8 wt % of magnesium (Mg).

* * * * *